US007507109B2

(12) United States Patent
Tran

(10) Patent No.: US 7,507,109 B2
(45) Date of Patent: Mar. 24, 2009

(54) STRAIN RELIEF ASSEMBLY

(75) Inventor: Phong H. Tran, Caledonia, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 11/757,667

(22) Filed: Jun. 4, 2007

(65) Prior Publication Data

US 2007/0224877 A1 Sep. 27, 2007

Related U.S. Application Data

(62) Division of application No. 11/276,888, filed on Mar. 17, 2006, now Pat. No. 7,234,197.

(60) Provisional application No. 60/594,206, filed on Mar. 18, 2005.

(51) Int. Cl.
*H01R 13/58* (2006.01)

(52) U.S. Cl. ..... 439/456; 174/153 G

(58) Field of Classification Search ..... 439/447, 439/456, 459, 501, 568; 174/151, 152 R, 174/153 R, 153 G, 662
See application file for complete search history.

(56) References Cited

U.S. PATENT DOCUMENTS 1,518,639 A * 12/1924 De Reamer ..... 439/456
2,573,600 A * 10/1951 Pruehs ..... 174/153 G
3,809,798 A * 5/1974 Simon ..... 174/59
3,958,300 A * 5/1976 Tanaka ..... 174/68.1
4,538,971 A 9/1985 Miller et al.
4,944,689 A * 7/1990 Carr ..... 439/417
5,318,158 A 6/1994 Seasholtz
5,564,944 A * 10/1996 Fukuda ..... 439/521
5,605,473 A * 2/1997 Kishon ..... 439/502
5,735,706 A * 4/1998 Ito ..... 439/402
5,782,653 A * 7/1998 Sandor ..... 439/467
5,906,426 A 5/1999 Farrington et al.
6,482,186 B1 * 11/2002 Douglas et al. ..... 604/218
6,971,905 B2 * 12/2005 Makita et al. ..... 439/447
2004/0200032 A1 10/2004 Morgan et al.
2004/0216264 A1 11/2004 Shaver

* cited by examiner

*Primary Examiner*—Thanh-Tam T Le
(74) *Attorney, Agent, or Firm*—McGarry Bair PC

(57) ABSTRACT

A spot cleaning apparatus comprises a fluid distribution system, a fluid recovery system, an agitation system, and a controller system to automatically monitor and control inputs and outputs to said systems for removal of spots and stains from a surface without attendance by a user. A suction nozzle and agitation device are mounted to the housing for movement over the surface to be cleaned relative to a stationary housing. Optionally, the spot cleaning apparatus can be operated in a manual mode. In one embodiment, the spot cleaning apparatus comprises a controller for continuously reversing the agitation direction of the agitation system. In another embodiment, the spot cleaning apparatus comprises a modular strain relief assembly. In yet another embodiment, working air is recirculated to the surface to be cleaned through internal ducting.

9 Claims, 6 Drawing Sheets

STRAIN RELIEF ASSEMBLY

CROSS-REFERENCE TO RELATED APPLICATION

This application is a divisional of U.S. patent application Ser. No. 11/276,888, filed Mar. 17, 2006, which claims the benefit of U.S. Provisional Application Ser. No. 60/594,206, which is incorporated herein by reference in its entirety. This application is related to PCT Application Publication No. WO2004/089179 filed Mar. 31, 2004 which claims the benefit of U.S. Provisional Application Ser. No. 60/320,071, filed Mar. 31, 2003, both of which are incorporated herein by reference in their entirety.

BACKGROUND OF THE INVENTION

1. Field of the Invention

This invention relates to an electrical appliance with a modular strain relief assembly.

2. Description of the Related Art

US20040216264 discloses in FIGS. 4 through 6, a motor assembly that includes a motor, a fan assembly, a power cord, a power switch, a set of isolators and a strain relief. The strain relief is coupled to the power cord to strengthen the portion of the power cord that enters into the housing, as well as to seal the housing so that air traveling through the vacuum is not discharged through the aperture through which the cord member extends. The strain relief 80 is illustrated as being fixedly coupled or formed with the insulative cover of the cord member 104, but the strain relief may be a discrete component that has been slid over the cord member.

U.S. Pat. No. 5,318,158 discloses in FIG. 5 a cord retainer for an appliance that includes a handle grip and a power cord extending from the rearward end of the grip. The cord enters the grip 51 through a cord hole (not illustrated) in a conventional manner, and a strain relief grommet or sleeve extends around a short length of the cord. The sleeve extends through or into the cord hole and is clamped by the handle grip 51, and the sleeve 53 prevents undesirable sharp bends of the cord adjacent the grip.

U.S. Pat. No. 4,538,971 discloses an appliance side wall that partially defines a junction box is provided with an aperture for a strain relief that surrounds a line cord. The electrical connections are made between the line cord, a switch and a motor, after which a clip secures the switch in its operative position and line cord is withdrawn until an appropriate length thereof remains in junction box after which the strain relief is snapped into the aperture.

US20040200032 discloses in FIG. 3 an exploded view of a handle that comprises two mating halves, a first power cord, a switch, a second power cord and a strain relief The first power cord is also connected to switch via power terminals and routed along inlet channel 304 and through the strain relief. The second power cord is routed along an outlet channel and connected to the switch via power terminals.

U.S. Pat. No. 5,906,426 discloses a housing 16 connected to a source of A.C. electrical power via a power cord through a strain relief. The details of power cord and strain relief are said to be more fully disclosed in co-pending application Ser. No. 08/873,832, filed Jun. 12, 1997. The housing includes a sloped rear surface that includes an elongated protrusion with a detent or projection on at least one of its upstanding surfaces. A tail housing further includes a channel member extending from the top surface of the housing.

SUMMARY OF THE INVENTION

According to the invention, a strain relief assembly for an appliance having an appliance housing and an electrical element mounted in the appliance housing and connected to an electrical cord for supplying power to the electrical element, the electrical cord extending into the appliance housing through the strain relief assembly comprises a first and second strain relief housing portions defining a wall that has an inlet aperture and an outlet aperture formed therein juxtaposed to one another and a U-shaped passageway for passage of the electrical cord therethrough between the inlet aperture and the outlet aperture.

The portions of the electrical cord that pass through the inlet and outlet aperture can be parallel to each other. Further, the portion of the electrical cord passing through on outlet aperture can be surrounded by a resilient collar that forms a bend relief device. The resilient collar can have at least one flange at one end that is received in a retaining cavity formed between the first and second strain relief housing portions at the outlet aperture.

In one embodiment, the inlet aperture can lie within the appliance housing and the outlet aperture can lie outside the appliance housing. A seating ridge can be formed on the first and second strain relief housing portions and can abut the appliance housing. Preferably, at least one rib can be formed on at least one of the first and second strain relief housing portions and extends into the U-shaped passageway to make an interference contact with the electrical cord.

In another embodiment, a pair of resilient tabs is formed on the first and second strain relief housing portions, resiliently deflects for insertion of the strain relief assembly through an opening in the appliance housing and seats behind the appliance housing after insertion through the opening.

Each of the first and second strain relief housing portions can have a boss extending toward each other and forming a portion of the U-shaped passageway. The bosses can have an opening therethrough for receiving a fastener that secures the first and second strain relief housing portions together.

DETAILED DESCRIPTION OF THE PREFERRED EMBODIMENT

Figure 1:
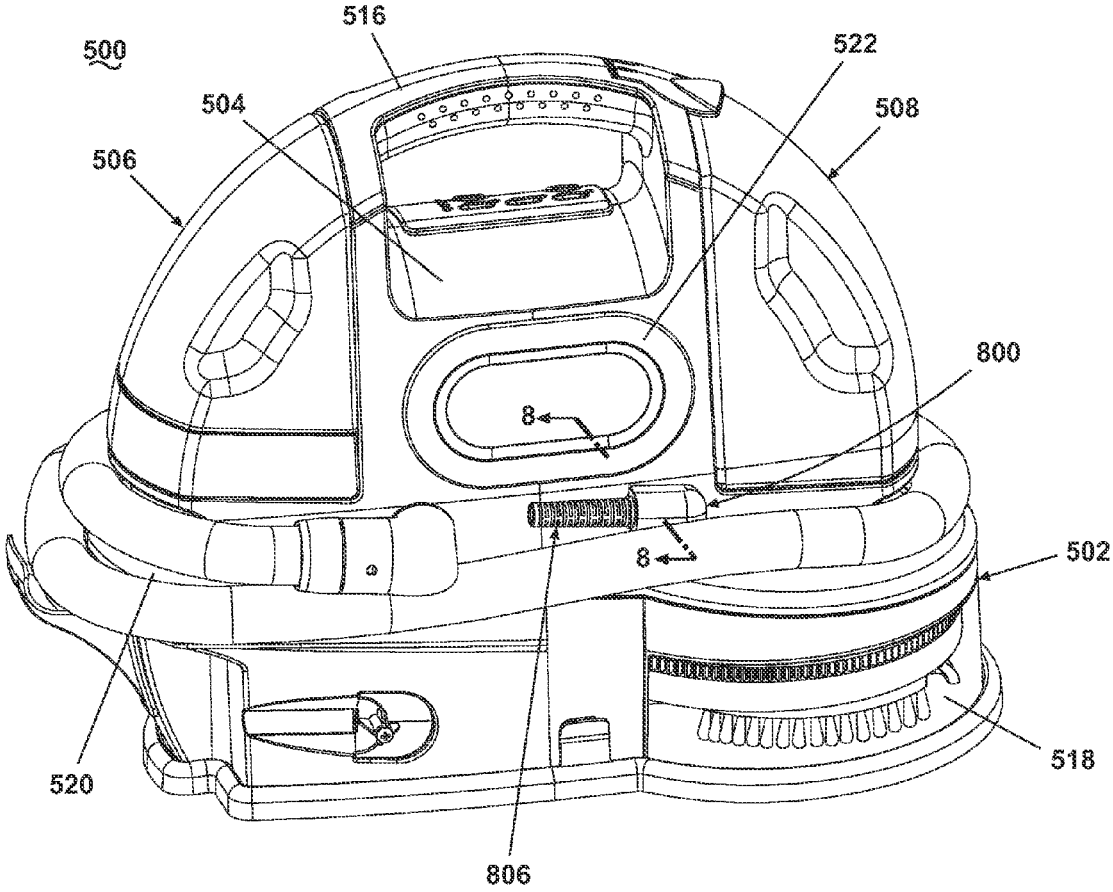
FIG. 1 is a rear perspective view of an appliance in the form of an unattended spot cleaning apparatus showing a modular strain relief according to the invention.

Referring to the drawings and in particular to FIG. 1, an appliance in the form of a spot cleaning apparatus 500 for unattended or manual cleaning of spots and stains on carpeted surfaces is show for illustration only. The spot cleaning apparatus illustrated in FIG. 1 is more fully disclosed in US 2006/0207052, which is incorporated herein by reference in its entirety. The spot cleaning apparatus 500 comprises a bottom housing or portion 502, a top housing or portion 504, a clean tank assembly 506, a recovery tank assembly 508, a carriage assembly (not shown), a motor/fan assembly (not shown), and a pump assembly (not shown). The bottom housing 502 rests on a surface to be cleaned, and the top housing 504 and the bottom housing 502 mate to form a cavity therebetween. A handle 516 is integrally formed at an upper surface of the top housing 504 to facilitate easy carrying of the spot cleaning apparatus 500. A carriage assembly lens 518 is attached to a forward lower section of the bottom housing 502 to define an opening in the underside of the bottom housing 502 and is preferably made from a transparent material for visibility of the carriage assembly 510 located behind the carriage assembly lens 518. Hose recesses 520 are integrally formed in a lower surface of the top housing 504 in forward and rearward locations.

A cord wrap 522 is slidably mounted to a side surface of the top housing 504 and, in an extended position, supports a power cord (not shown) for easy storage thereof The power cord is mounted to the top housing 504 with a modular strain relief assembly 800, as will be described in more detail below.

Figure 2:
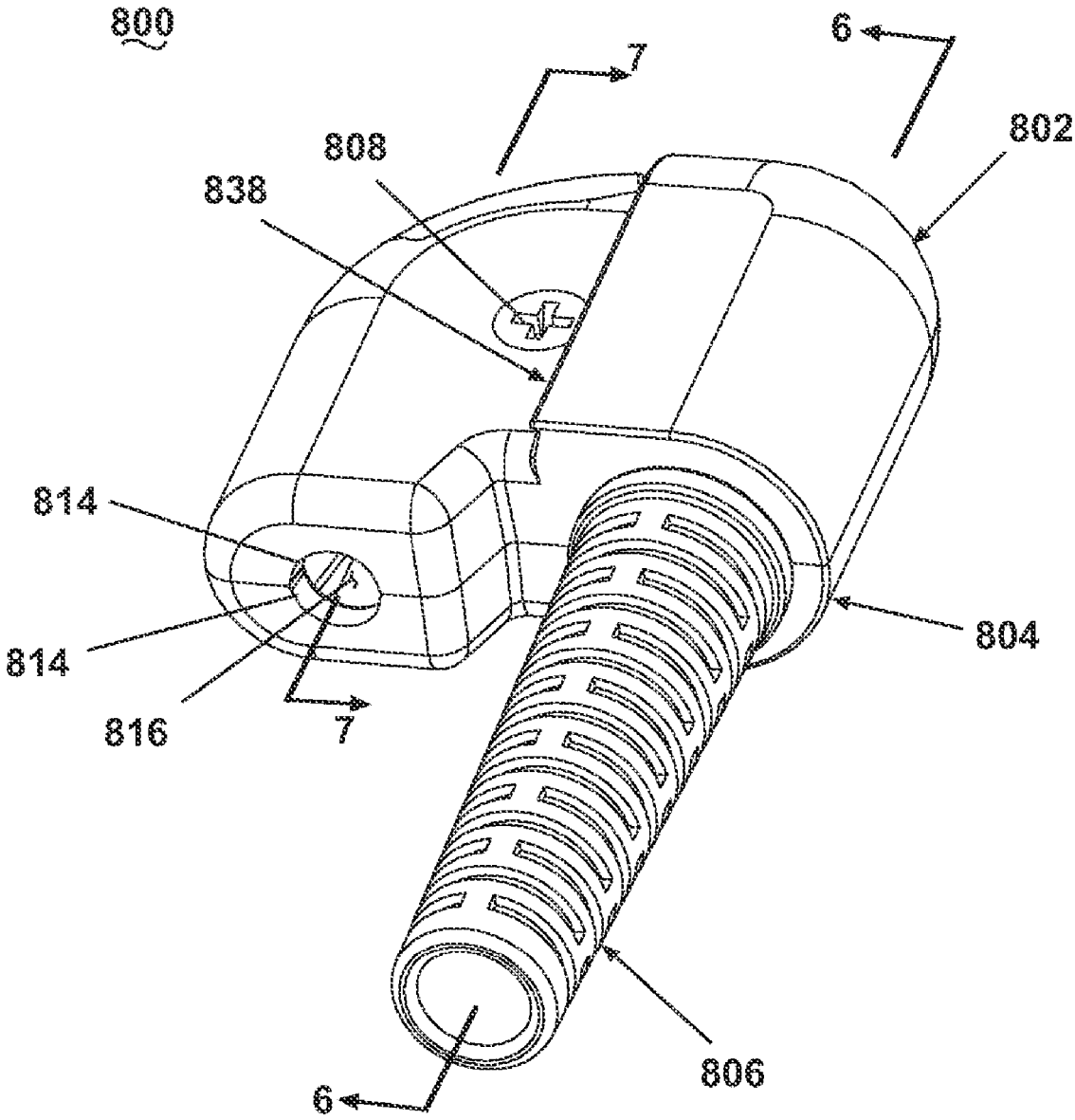
FIG. 2 is a perspective view of a modular strain relief assembly of the unattended spot cleaning apparatus shown in FIG. 1.
Figure 3:
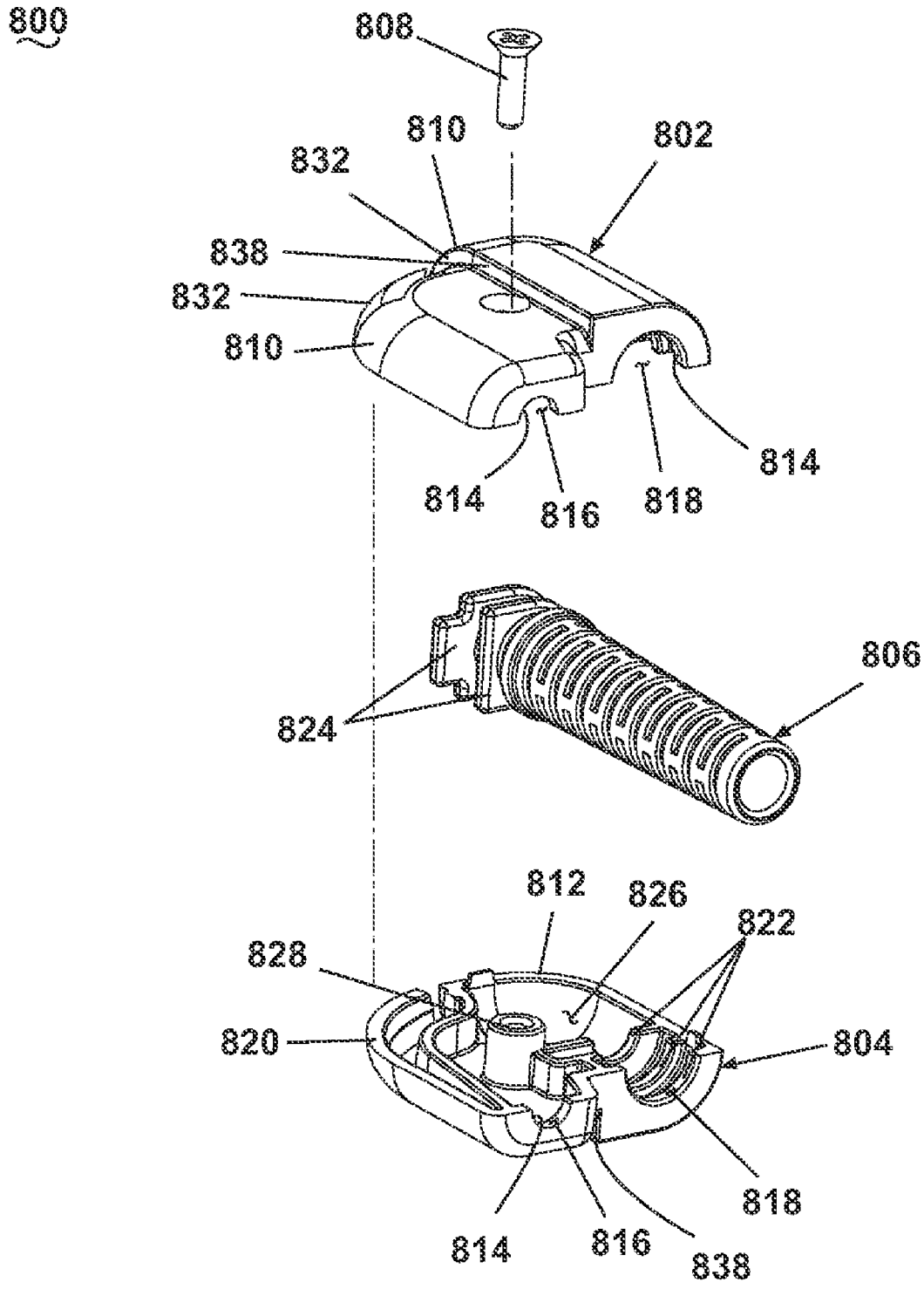
FIG. 3 is an exploded view of the modular strain relief assembly shown in FIG. 2.
Figure 4:
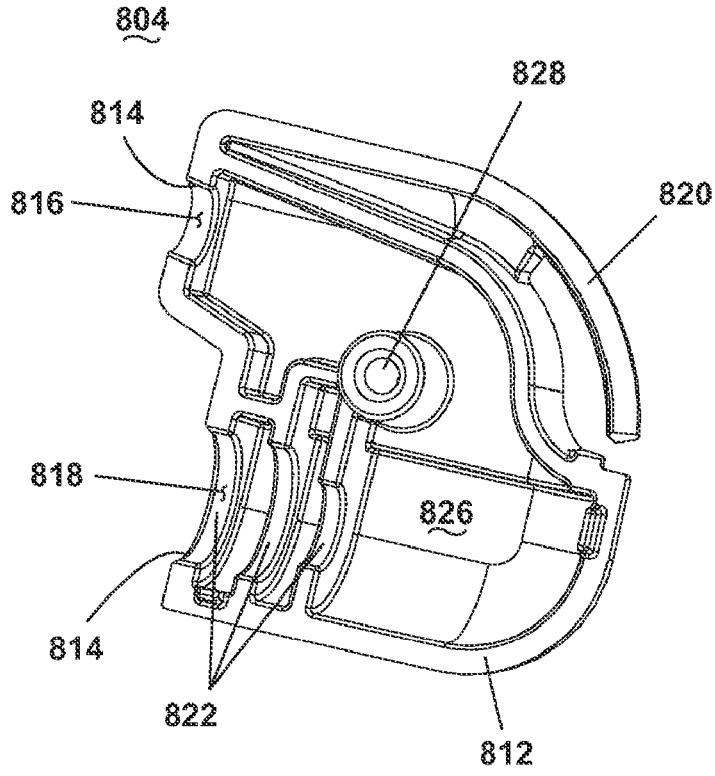
FIG. 4 is a perspective view of a lower housing of the strain relief assembly shown in FIG. 3.
Figure 5:
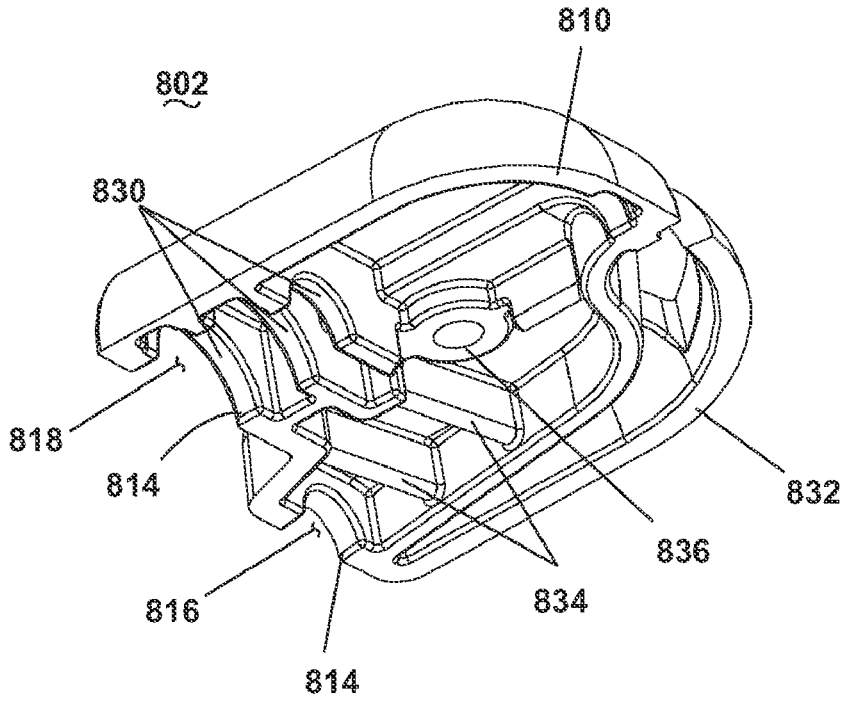
FIG. 5 is a perspective view of an upper housing of the strain relief assembly shown in FIG. 3.
Figure 6:
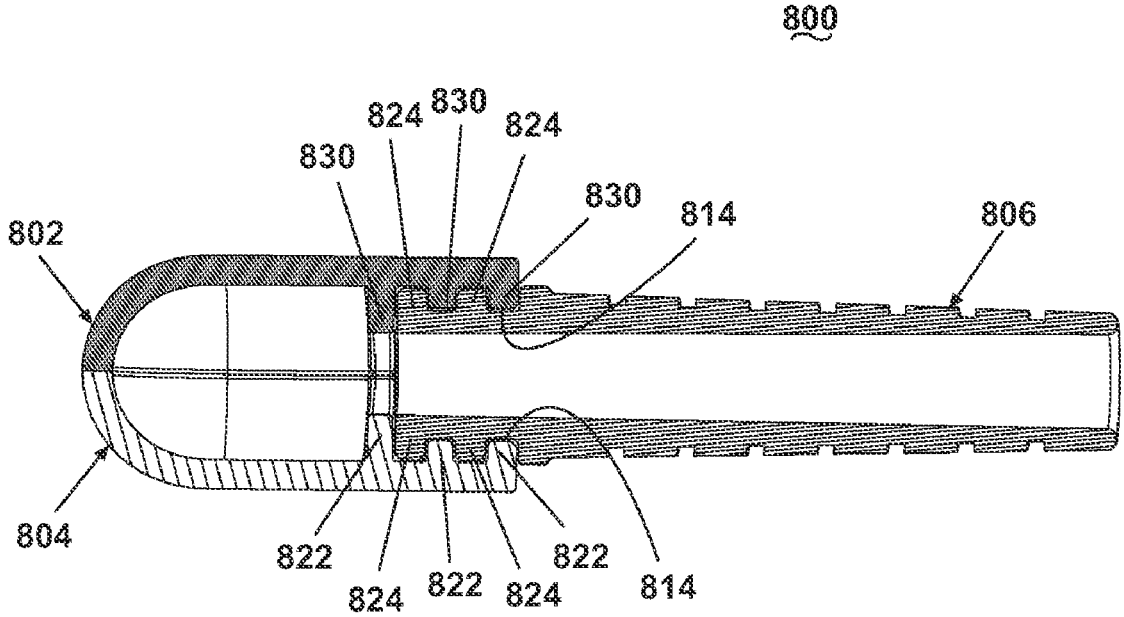
FIG. 6 is a section view of the strain relief assembly taken along line 6-6 of FIG. 2.
Figure 7:
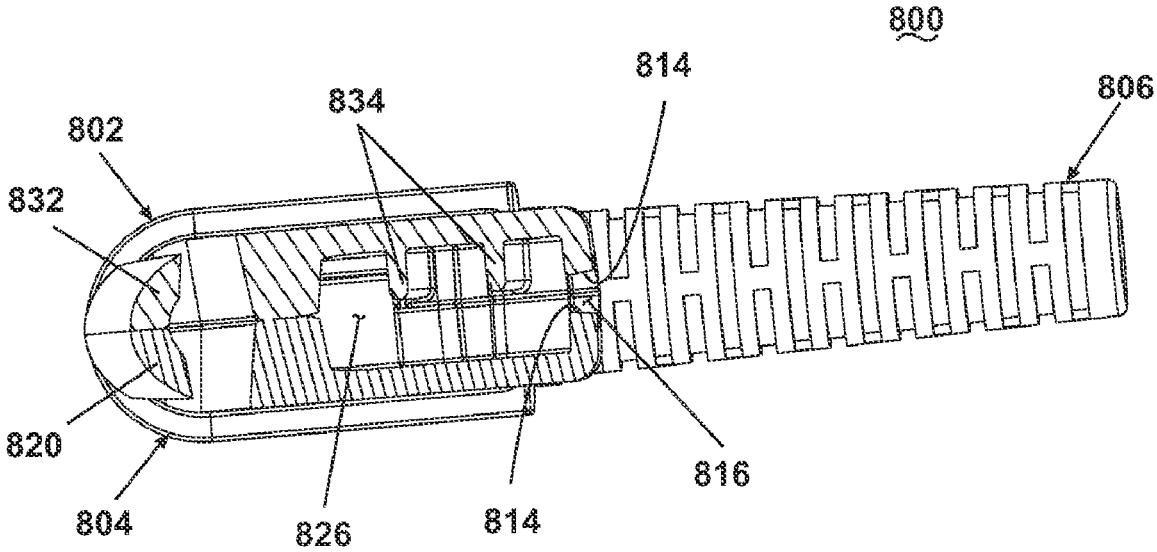
FIG. 7 is a section view of the strain relief assembly taken along line 7-7 of FIG. 2.

Referring to FIGS. 2 and 3, the modular strain relief assembly 800 further comprises an upper housing 802, a lower housing 804, a commonly known bend relief device 806 that prevents outerjacket of the power cord from excessive bend radii, and a commonly known screw 808 or other suitable fastening device. The assembled modular strain relief assembly 800 forms a passage in which the power cord is securely retained. Both the upper housing 802 and lower housing 804 comprise an outer wall 810 and 812, respectively that forms the basic structure for the enclosure. Both the upper housing 802 and lower housing 804 further comprise a pair of semicircular arcuate cut-outs 814 sized and positioned such that when the housings 802, 804 are mated, the cut-outs form a generally circular aperture 16 therethrough. One aperture 816 is sized to allow the power cord to pass while the other aperture 818 is sized to receive the bend relief 806.

Referring to FIGS. 3-7, the lower housing 804 further comprises a resilient lower tab 820 that joins the outer wall 812 at one end and is unattached at the other end and is laterally displaceable when exposed to an external force. A plurality of bend relief retaining walls 822 formed near the bend relief aperture 818 engage with a corresponding set of retaining walls 824 formed in one end of the bend relief 806. A generally U-shaped power cord passage 826 is formed on an interior of the lower housing 804 around a generally centrally located integrally formed screw boss 828. The upper housing 802 also has a plurality of bend relief retaining walls 830 that correspond with the retaining walls 822 on the lower housing 804 so that, when assembled, effectively secure the bend relief 806 with the assembled housings 802, 804. The upper housing 802 also incorporates a resilient tab 832 that mirrors the lower housing 804 resilient tab 820 and is capable of flexing in a similar manner. Unlike the lower housing 804, however, the upper housing 802 further comprises a plurality of strain relief ribs 834 that depend orthogonally from an inner surface of the outer wall 810 into the passage 826, near the power cord aperture 816 formed by the corresponding cut-outs 814. The strain relief ribs 834 are sized to make an interference contact with the outer jacket of the power cord to effectively retain the cord in the strain relief assembly 800 but not so far that they apply excessive pressure to the inner conductors contained within the outer jacket. Excessive pressure on the inner conductors can cause cold flow of the insulators, resulting in undesirable direct contact of the internal conductors. A screw aperture 836 is formed though the outer wall 810 and is in axial alignment with the corresponding screw boss 828 integrally formed in the lower housing 804.

To assemble the modular strain relief assembly 800, the bend relief 806 is slipped over the outer jacket of the power cord. The power cord and bend relief 806 are laid in the lower housing 804 so that the bend relief retaining walls 824 engage with the lower housing bend relief walls 822. The power cord is routed around the screw boss 828 and exits the lower housing at the power cord aperture 816 formed by the cut-out 814. The upper housing 802 is placed over the lower housing 804 so that the outer walls (810, 812), resilient tabs (820, 832) screw aperture 836, and screw boss 828 are in alignment. The screw 808 is inserted through the screw aperture 836, is captured by the screw boss 828, and is tightened such that the strain relief ribs 834 make an interference contact with the power cord outer jacket.

Figure 8:
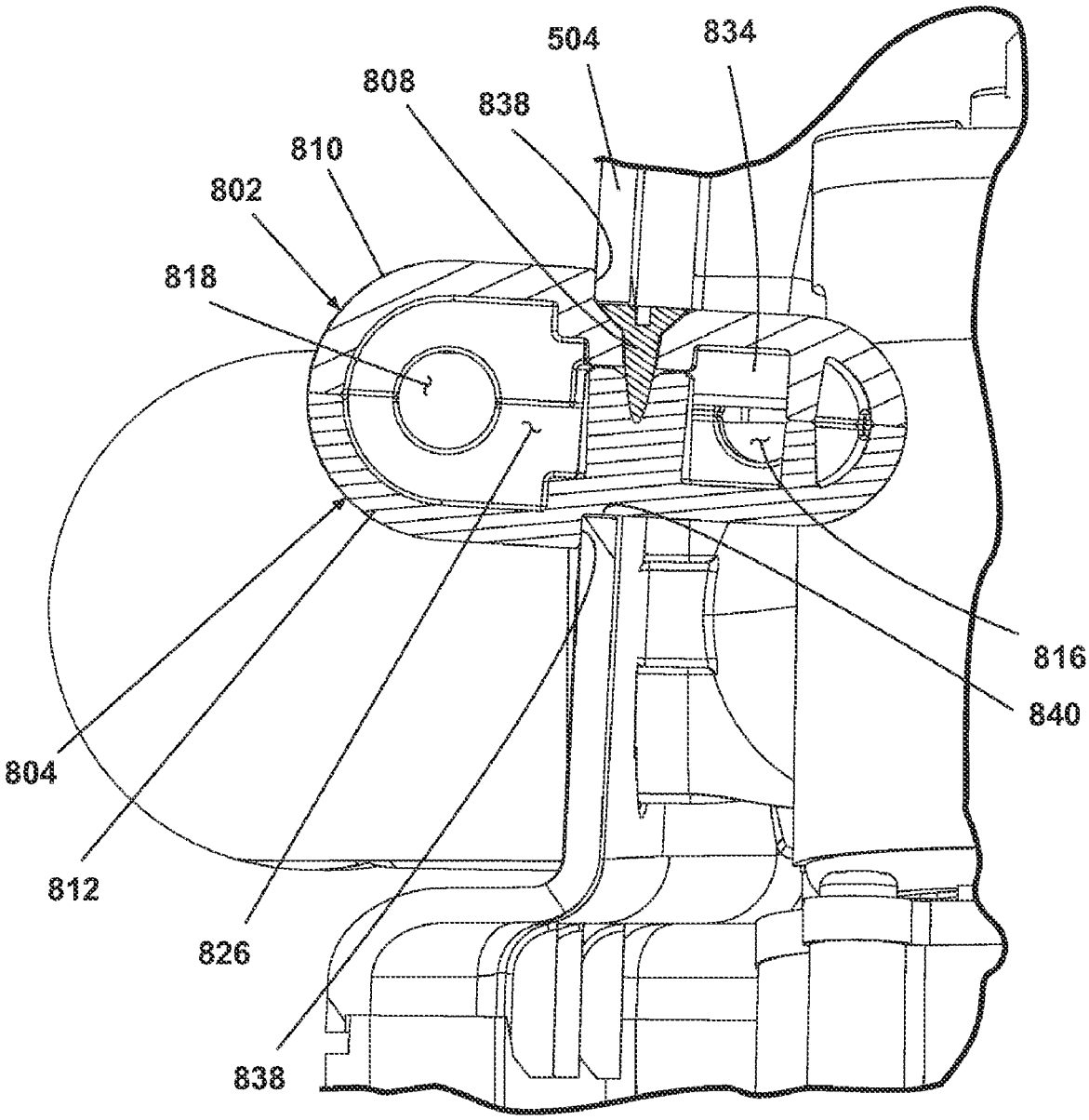
FIG. 8 is a section view of the strain relief assembly installed in the unattended spot cleaning apparatus taken along line 8-8 of FIG. 1.

Referring to FIGS. 2 and 8, the assembled modular strain relief assembly 800 forms a seating surface 838 comprising a rib-like structure on each of the housings 802, 804 that mates with the outer surface of the top housing 504. An aperture 840 of suitable size is formed through the top housing 504 to receive the strain relief assembly. To assemble the modular strain relief to the top housing 504, the free end of the power cord is inserted through an aperture 840 in the top housing 504. The power cord aperture 816 is also inserted into the housing aperture 840 and positioned such that the wall of the housing aperture is in contact with the strain relief outer walls (810, 812). The strain relief assembly 800 is then rotated about this point so that the resilient tabs (820, 832) are forced past an opposite side of the aperture 840, displacing the tabs (820, 832) so that they pass through the aperture 840. Once the tabs (820, 832) pass the aperture 840 wall, the tabs (820, 832) return to their previous position thus locking the modular strain relief assembly to the top housing 504 as shown in FIG. 8.

The installed modular strain relief assembly 800 serves to secure the power cord to the housing 504 in a manner that relieves strain on the internal connections within the housing 504 by virtue of the tortuous U-shaped path and the engagement of the strain relief ribs 834 with the power cord outer jacket. In addition, the bend relief 806 limits the bend radius of the out jacket at the exit of the top housing 504 to minimize fatigue failures in this area. Alternatively, any conventional strain relief device can be used to secure the power cord to the housing.

While the invention has been specifically described in connection with certain specific embodiments thereof, it is to be understood that this is by way of illustration and not of limitation. Reasonable variation and modification are possible within the scope of the forgoing description and drawings without departing from the scope of the invention that is described in the appended claims.

I claim:

1. A strain relief assembly for an appliance having an appliance housing and an electrical element mounted in the appliance housing and connected to an electrical cord for supplying power to the electrical element, the electrical cord extending into the appliance housing through the strain relief assembly, which comprises:

first and second strain relief housing portions that are mated together in juxtaposed relationship with each other and that have complementary structure to define them a U-shaped passageway that has an inlet aperture and an outlet aperture formed therein juxtaposed to one another for passage of the electrical cord through the U-shaped passageway between the inlet aperture;

wherein a first portion of the electrical cord passes through the inlet aperture and a second portion of the electrical cord passes through the outlet aperture and the first and second portions of the electrical cord are parallel to each other.

2. A strain relief assembly according to claim 1, wherein the second portion of the electrical cord passing through the outlet aperture is surrounded by a resilient collar that is adapted to relieve bending stress on the electrical cord.

3. A strain relief assembly according to claim 2, wherein the resilient collar has at least one flange at one end that is received in a retaining cavity formed between the first and second strain relief housing portions at the outlet aperture.

4. A strain relief assembly according to claim 1, wherein the inlet aperture lies within the appliance housing and the outlet aperture lies outside the appliance housing.

5. A strain relief assembly according to claim 4, wherein a seating ridge is formed on the first and second strain relief housing portions and abuts the appliance housing.

6. A strain relief assembly according to claim 1, wherein at least one rib is formed on at least one of the first and second strain relief housing portions and extends into the U-shaped passageway to make an interference contact with the electrical cord.

7. A strain relief assembly according to claim 1, wherein a pair of resilient tabs are formed on the first and second strain relief housing portions that resiliently deflect for insertion of the strain relief assembly through an opening in the appliance housing and seat behind the appliance housing after insertion through the opening.

8. A strain relief assembly according to claim 1, wherein each of the first and second strain relief housing portions have a boss extending toward each other and forming a portion of the U-shaped passageway.

9. A strain relief assembly according to claim 8, wherein the bosses have an opening therethrough for receiving a fastener that secures the first and second strain relief housing portions together.

* * * * *